US008714162B1

(12) United States Patent
Johnson

(10) Patent No.: US 8,714,162 B1
(45) Date of Patent: May 6, 2014

(54) PORTABLE PIPE BOWL CLEANER

(76) Inventor: Brett Johnson, Talent, OR (US)

( * ) Notice: Subject to any disclaimer, the term of this patent is extended or adjusted under 35 U.S.C. 154(b) by 839 days.

(21) Appl. No.: 12/896,816

(22) Filed: Oct. 1, 2010

(51) Int. Cl.
*A24F 11/00* (2006.01)

(52) U.S. Cl.
USPC ..... 131/328; 131/232; 15/106; 15/164; 15/211; 248/133; 403/267

(58) Field of Classification Search
None
See application file for complete search history.

(56) References Cited

U.S. PATENT DOCUMENTS

| | | | | |
|---|---|---|---|---|
| 1,356,586 | A | 10/1920 | Alsenstein | |
| 1,735,803 | A | 11/1929 | Stern | |
| 2,038,370 | A | 4/1936 | Leibner | |
| 2,103,754 | A | 12/1937 | Pearace | |
| 2,175,199 | A | 10/1939 | La Beaume | |
| 2,189,842 | A | 2/1940 | Smeby | |
| 2,347,941 | A | 5/1944 | Eweson | |
| 2,559,994 | A * | 7/1951 | Paludan | 131/246 |
| D202,681 | S | 10/1965 | Schmutte | |
| 3,299,897 | A | 1/1967 | Rhoads | |
| 3,351,068 | A | 11/1967 | Sequeira | |
| 3,387,614 | A | 6/1968 | Beuscher | |
| 4,027,681 | A | 6/1977 | Todd et al. | |
| 5,209,248 | A | 5/1993 | Slade, Sr. | |
| 7,017,222 | B2 * | 3/2006 | Dunn | 15/106 |

* cited by examiner

*Primary Examiner* — Richard Crispino
*Assistant Examiner* — Phu Nguyen
(74) *Attorney, Agent, or Firm* — Jerry Haynes Law

(57) ABSTRACT

A portable pipe bowl cleaner may include a poker for cleaning pipe bowls. The poker may generally extend linearly and have a top portion that is used to perform the cleaning. The portable pipe bowl cleaner may also include a base and a suction cup. One side of the base may be coupled with a bottom portion of the poker. Another side of the base may be coupled with the suction cup. The suction may have an internal cup surface that is capable of being removably affixed to a smooth, non-porous surface.

A method of using a portable pipe bowl cleaner may include holding the base over a smooth, non-porous surface, with the suction cup facing toward the surface. By momentarily pressing the base toward the surface, the suction cup is pressed against and removably affixed to the surface.

15 Claims, 5 Drawing Sheets

PORTABLE PIPE BOWL CLEANER

FIELD

This invention relates to a pipe bowl cleaner. More specifically, this invention relates to a portable pipe bowl cleaner. In some embodiments the portable pipe bowl cleaner has a detachable poker.

BACKGROUND

Pipes, bowls, stems and other smoking devices often become clogged with steady use. A pipe bowl cleaner with a poker is often used to clear a clogged smoking passage for better airflow through a pipe, bowl, stem, or other smoking device. Pipe bowl and bowls in general are almost always convex-shaped semi-spheres, much like the shape of a cereal bowl except a hole in the bottom allows air and smoke to flow through.

Pipe bowls are sometimes cleaned with a poker. In some cases, a pipe bowl is a cup-shaped object which is open at the top and which has a small hole opposite the open top. A poker is a narrow length of material—often metal—which can be inserted in be small hole to draw ash out of the pipe bowl through the small hole. A poker can be used for many things such as stirring the contents in the bowl, scraping, and clearing unwanted material out of a bowl.

Or, a poker may be used to access the pipe bowl through the open top of the pipe bowl. In this case, the pipe bowl may be turned upside down to allow the ash to fall out of the pipe bowl as a poker is used to scrape ashes out of the pipe bowl.

Thus, at least some pipe bowl cleaners include a poker. The poker in turn may be attached to a variety of implements from handles to ash-trays. In some cases, it may be desirable to design a pipe bowl cleaner that has a poker and that is portable.

Certain design issues may be considered with designing a portable pipe bowl cleaner. One design consideration is the overall size of the pipe bowl cleaner. A cleaner which is heavy and bulky is less likely to be conveniently portable.

Another possible design consideration may be whether the cleaner may be carried on one's person and used independently of any particular ashtray or other device. Another design consideration may be the extent to which the pipe bowl cleaner may be at least partly disassembled when not in use to make it easier to transport the pipe bowl cleaner.

Another possible design consideration may be whether the pipe bowl cleaner may be temporarily attached to a surface or to another device—such as an ashtray—for use in cleaning a pipe bowl.

SUMMARY

In some embodiments, a portable pipe bowl cleaner includes a generally linearly extending poker, the poker having a bottom portion and a top portion. In some embodiments the bottom portion of the poker is shorter and wider than the top portion. The portable pipe bowl cleaner may also include a base and a suction cup. The base may have first and second sides. The first side of the base may be capable of being coupled with the bottom portion of the poker. In some embodiments, the first side of the base may be capable of being detachably coupled with the bottom portion of the poker.

The second side of the base may be capable of being coupled with an exterior surface of the suction cup. The suction cup may have an internal cup surface that is capable of being removably affixed with a smooth, non-porous surface.

In some embodiments, a method of using a portable pipe bowl cleaner may include holding a base of the portable pipe bowl cleaner over a smooth non-porous surface. The holding may be performed with the base positioned between the surface and a poker, the poker being coupled with a first side of the base. The holding may further be performed with the suction cup positioned between the surface and the base, the suction cup being coupled with a second side of the base. In some embodiments, the method includes removably affixing the suction cup to the surface. The method may further include cleaning a pipe bowl with the poker.

DETAILED DESCRIPTION

In the following description, various embodiments are described with reference to the various drawings. As a preliminary note before turning to the description, with reference to the drawings, some clarification is offered regarding terminology used in the description.

When multiple statements are made regarding "some embodiments", these "some embodiments" may or may not be the same sets of embodiments. When multiple statements are made regarding "one embodiment", these separate statements may not be referring to the same embodiment. Also, unless the context indicates otherwise, the singular includes the plural.

As used in this document, unless the context indicates otherwise, the term "coupled with" includes its ordinary meaning and in particular includes either a direct coupling or an indirect coupling. For example, if element A is "coupled with" element C, then at least the following two statements may be true: 1) element A is directly coupled with element C; or 2) Element A is coupled with element B and Element B is coupled with Element C—an indirect coupling of Element A with Element C. The term "coupled with" is not restricted to one level of indirect coupling and includes a plurality of indirect couplings.

In some embodiments, as described in more detail below, a portable pipe bowl cleaner includes a base for holding the portable pipe bowl cleaner and a poker that is detachably coupled with the base. This allows the poker to be easily used for non-stationary use. In some embodiments, the poker is magnetic and thus is magnetically detachably coupled with the base, for easy detachment and reattachment to the base.

Figure 1:
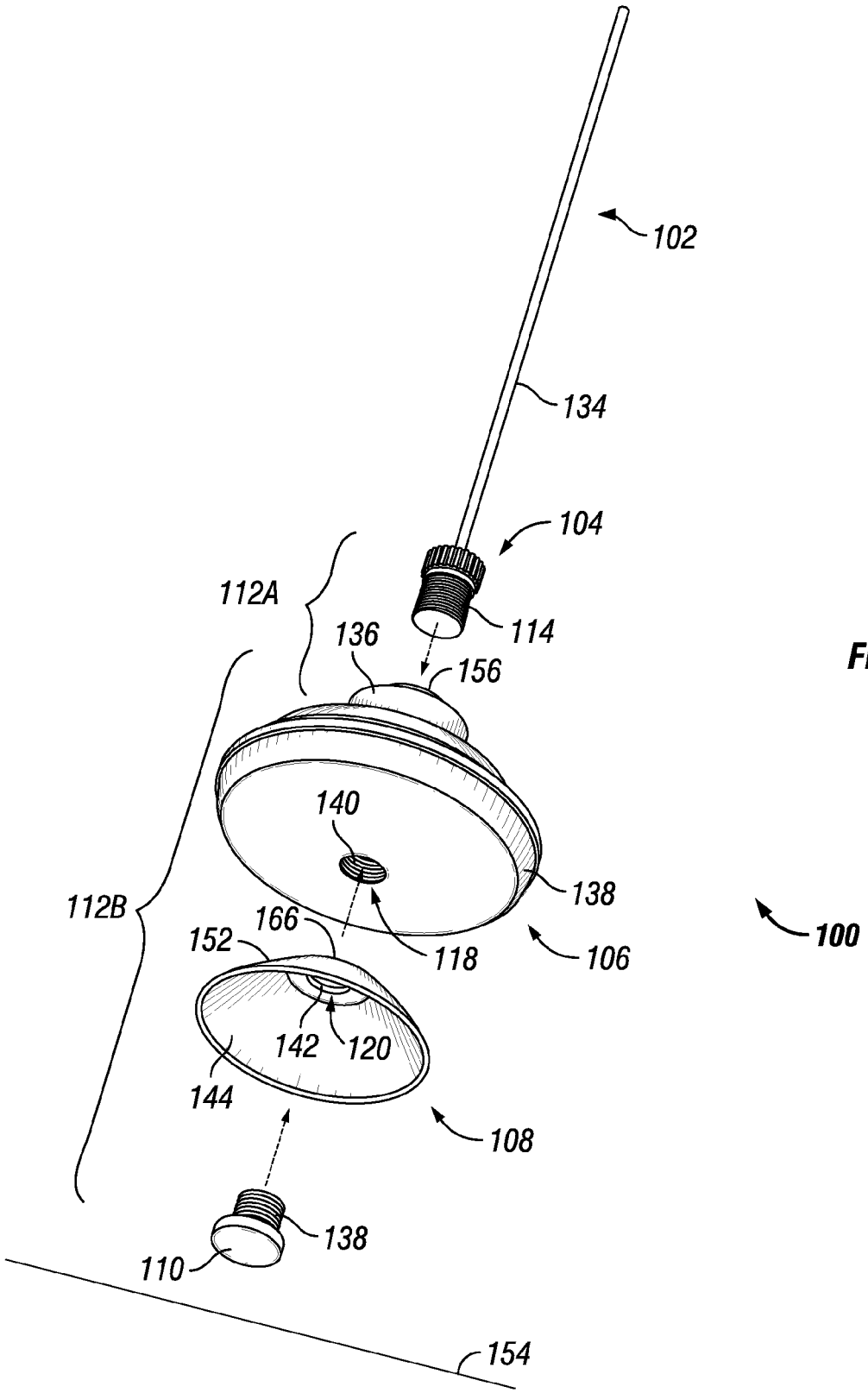
FIG. 1 is an exploded, perspective drawing of a portable pipe bowl cleaner, in accordance with some embodiments, showing a poker, a base, and a suction cup.
Figure 1A:
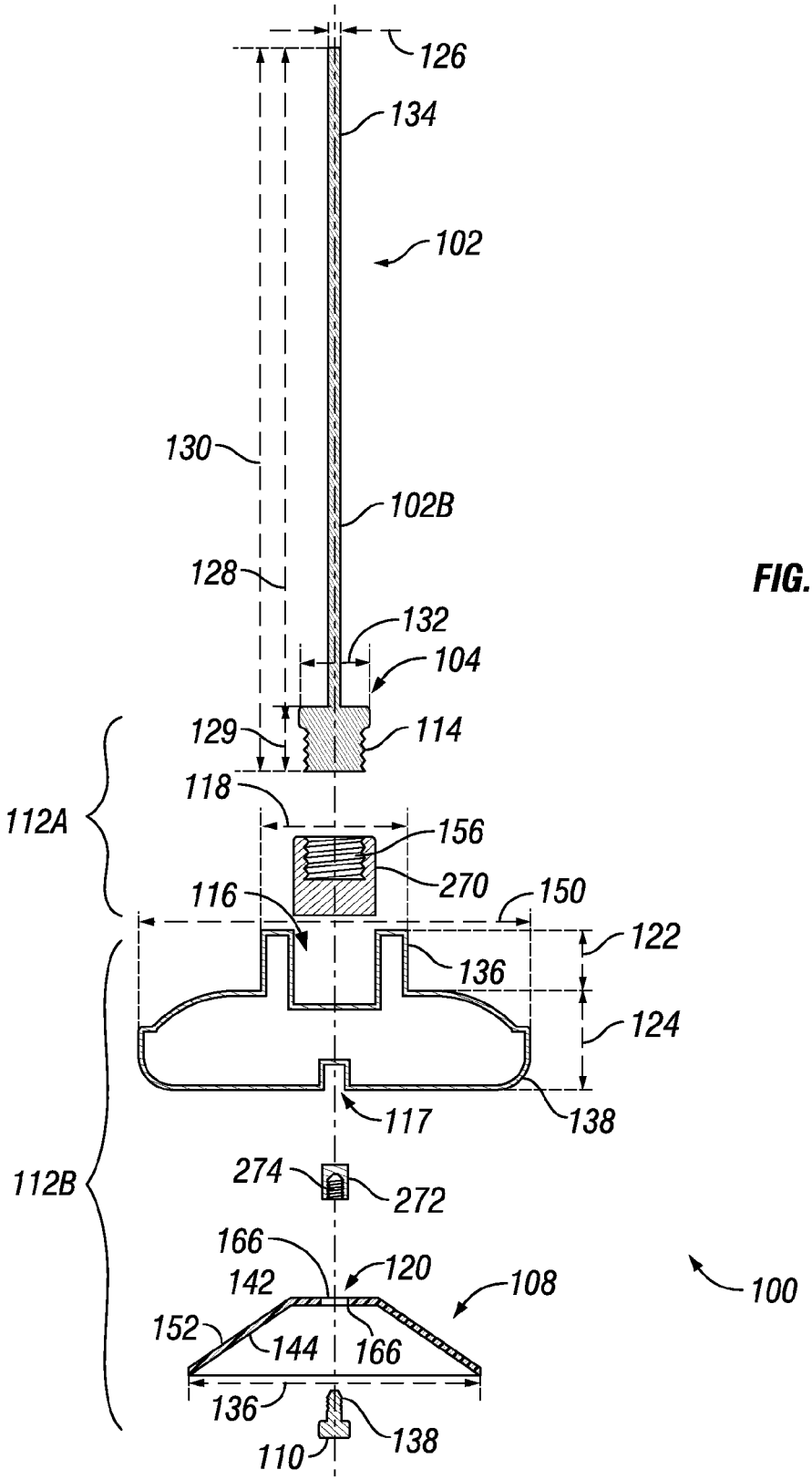
FIG. 1A is an exploded, sectional, two-dimensional drawing showing a front view of the portable pipe bowl cleaner of FIG. 1, in accordance with some embodiments.

Referencing FIGS. 1 and 1A, in some embodiments, a portable pipe bowl cleaner 100 includes a generally linearly extending poker 102 that has a top portion 134 and a bottom portion 104. The portable pipe bowl cleaner 100 further includes a base 106 having a first side 136 that is capable of being coupled with the bottom portion 104 of the poker 102. The base 106 of the portable pipe bowl cleaner 100 also has a second side 138. In some embodiments, the first side 136 and the second side 138 may oppose each other, that is being opposing sides of the base 106.

The portable pipe bowl cleaner 100 also includes a suction cup 108 that has an exterior surface 152 and an internal cup surface 144. A center portion 142 of the exterior surface 152 of the suction cup 108 is capable of being coupled with the second side 138 of the base 106. The suction cup 108 has the usual properties of a suction cup. For example, its interior cup surface 144 is capable of being removably affixed to a smooth, non-porous surface 154. The surface 154 could be, for example, glass, smooth wood, sheetrock, metal, plastic, ceramic, or some other smooth, non-porous surface.

In some embodiments, the suction cup 108 is removably affixed to a surface 154 of glass comprising an interior, bottom surface of an ashtray (not shown). Then, when the top portion 134 of the poker 102 is used to clean ashes from a pipe bowl, the ashes may fall conveniently in the ashtray. But an ashtray is not necessary for use of the portable pipe bowl cleaner 100.

In some embodiments, the suction cup 108 of the portable pipe bowl cleaner 100 is capable of being removably attached to a desktop. When the top portion 134 of the poker 102 is then used to clean a pipe bowl, the ashes may fall on the flat desk surface where they may be easily wiped up.

While the embodiments shown in FIGS. 1 and 1A have a single suction cup, the invention is not restricted to the use of a single suction cup. In some embodiments, there are two or more suction cups 108 coupled with the second side 138 of the base 106. In one embodiment, the two or more suction cups 108 are each connected to separate legs that are then connected with the second side of the base 106. Those skilled in the art can imagine multiple means for coupling two or more suction cups 108 to the second side of the base 106.

The materials for the parts of the portable pipe bowl cleaner 100 can vary. In some embodiments, the poker 102 is made of a metal, such as steel. In some embodiments, the base 106 is made of wood. In some embodiments, the base 106 is made of metal. In some embodiments, the suction cup is made of rubber.

Further referencing FIGS. 1 and 1A, in some embodiments, the dimensions of the various parts of the portable pipe bowl cleaner 100 are modest. Therefore, the suction cup 108 does not need to be very large to removably couple the portable pipe bowl cleaner 100 to a surface 154. In some embodiments, the suction cup 108 defines a diameter 136 of between one and two inches. In one embodiment, the diameter 136 of the suction cup 108 is 1¼ inches.

Figure 2:
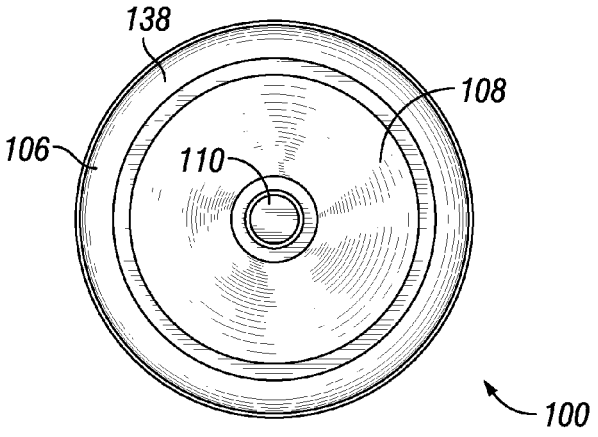
FIG. 2 is a two-dimensional, bottom view of the portable pipe bowl cleaner of FIG. 1, in accordance with some embodiments, showing a bottom view of a suction cup affixed to the portable pipe bowl cleaner.

Referencing FIG. 2, in some embodiments, as seen from a bottom view, a portable pipe bowl cleaner 100 has a suction cup 108 that is just slightly smaller in diameter than the second side 138 of the base 106. Thus, in some embodiments, the suction cup and diameter are fairly close together in terms of their diameter or width. The suction cup may be coupled with the base 106, either directly or indirectly, by a fastener 110 (e.g., a threaded bolt or screw). A coupling mechanism 112A incorporating a fastener is discussed below.

Continuing to reference FIGS. 1 and 1A, in some embodiments the top portion 134 of the poker 102 defines a first diameter 126 and the bottom portion 104 of the poker 102 defines a second diameter 132. In some embodiments, the second diameter 132 is twice as great as the first diameter 126. In one embodiment, the first diameter 126 is 1/16 inch and the second diameter 132 is ¼ inch.

The length 130 of the poker 102 may vary. In some embodiments, the length 130 of the poker 102 is between two and five inches. In one embodiment, the bottom portion 104 of the poker 102 has a bottom length 129 of ¼ inch, the top portion 134 of the poker has a top length 128 of 3¼ inches and the entire poker has a length 130 of 3½ inches.

In some embodiments, the base 106 has a first side 136 with different dimensions than its second side 138. In some embodiments, the first side 136 has a smaller overall size than the second side 138 of the base 106. For example, in some embodiments, the first side 136 serves as a neck or stem to couple with the narrower bottom portion 104 of the poker 102. In some embodiments, the second side 138 serves as a handle or hand-grip which a human may use to handle the portable pipe bowl cleaner 100.

Thus, in some embodiments, the first side 136 defines a first base height 122 and a first base diameter 118 and the second side defines a second base height 124 and a second base diameter 150. In some embodiments, the second base height 124 is greater than the first base height 122 and the second base diameter 150 is greater that the first base diameter 118. In one embodiment, the second base diameter 150 of the second side is 1⅝ inches, the second base height 124 is ¼ inch and the first base height 122 is ⅛ inch.

Continuing with reference to FIGS. 1 and 1A, in some embodiments, the portable pipe bowl cleaner 100 comprises a poker coupling mechanism 112A. In some embodiments, the poker coupling mechanism 112A is capable of directly or indirectly coupling the bottom portion 104 of the poker 102 with the first side 136 of the base 106. In some embodiments, the poker coupling mechanism 112A includes a liner 270 that lines a cavity 116 defined by the first side 136 of the base 106. The liner 270 is capable of receiving at least a portion of the bottom portion 104 of the poker 102. For example, in particular embodiments, if the first height 122 is ⅛ inch and the height 129 of the bottom portion is ¼ inch, then ⅛ inch of the bottom portion may protrude from the cavity 116.

Figure 3:
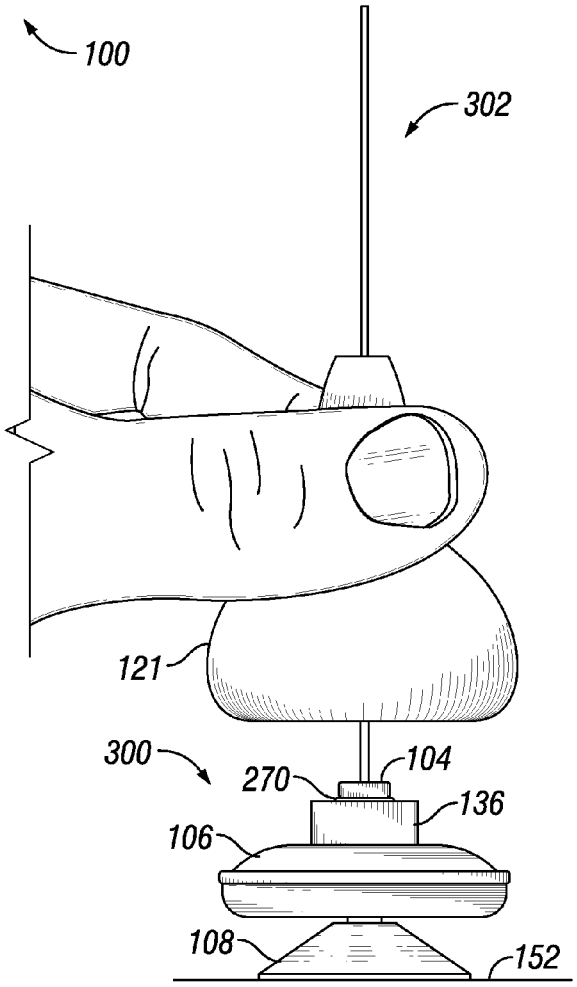
FIG. 3 is a perspective drawing of the portable pipe bowl cleaner similar to that of FIG. 1, in accordance with some embodiments, showing the portable pipe bowl cleaner being used to clean a pipe bowl.

Referencing FIG. 3, a portable pipe bowl cleaner 300, similar to portable pipe bowl cleaner 100 of FIG. 1, is being used to clean a pipe bowl 121. The suction cup 108 is shown removably affixing the portable pipe bowl cleaner 100 to a surface 152. In the embodiment shown, a part of the bottom portion 104 protrudes from the liner 270 that lines a cavity 116 (FIG. 1A) defined by the base 106. A long poker 302 easily extends from the liner 270 through the pipe bowl and beyond. Because of the shape and size of the bottom portion 104 of the poker 302, a user may use the bottom portion 104 as a packer. In other embodiments, the bottom portion 104 may entirely fit within the liner 270 that lines cavity 116 of the first side 136 of the base 106.

Further referencing FIGS. 1 and 1A, in some embodiments, the poker coupling mechanism 112 A couples the base 106 with the bottom portion 104 of the poker 102, via a liner 270 or bushing which lines the cavity 116 defined by the first side 136 of the base 106. In some embodiments, the liner 270 or bushing has the internal threads 156 which threadingly engage the external threads 114 of the bottom portion 104 of the poker 102. In some embodiments, the liner 270 may be of metal, while the base 206 is made of wood and the extra hardness of metal is desired for the threads 156. In some alternative embodiments, a base 106 is made primarily of metal and so a separate metal liner or bushing may not be as desirable.

Thus, in alternative embodiments there is no liner. The poker coupling mechanism 112A may comprise external threads 114 defined by the bottom portion 104 of the poker 102 and internal threads 156 defined by the cavity 116. The external threads 114 are capable of threadingly engaging the internal threads 156 of the cavity 116 to couple the bottom portion 104 of the poker 102 to the first side 136 of the base 106.

In some embodiments, the poker coupling mechanism 112A may use one or more magnets and ferromagnetic material (e.g., material attracted to magnets) to directly or indirectly couple the bottom portion 104 of the poker 102 with the first side 136 of the base 106 that defines the cavity 116. When magnets are used, threads are not required. In some embodiments, this may allow a poker 102 to be quickly and conveniently mounted to a base and then quickly disassembled when the poker 102 is not in use.

In at least some embodiments discussed above, the bottom portion of the poker is detachably coupled with the base. That is, when the bottom portion of a poker is coupled to the base by threads or by magnets, then the poker may be detached from the base. In alternative embodiments, the bottom portion of the poker is permanently coupled with the base. In some embodiments, the poker and the base may not be separate from one another, but carved or forged out of a single piece of material, such as wood or metal. In some embodiments, the poker and the base may be welded or glued together.

Figure 4:
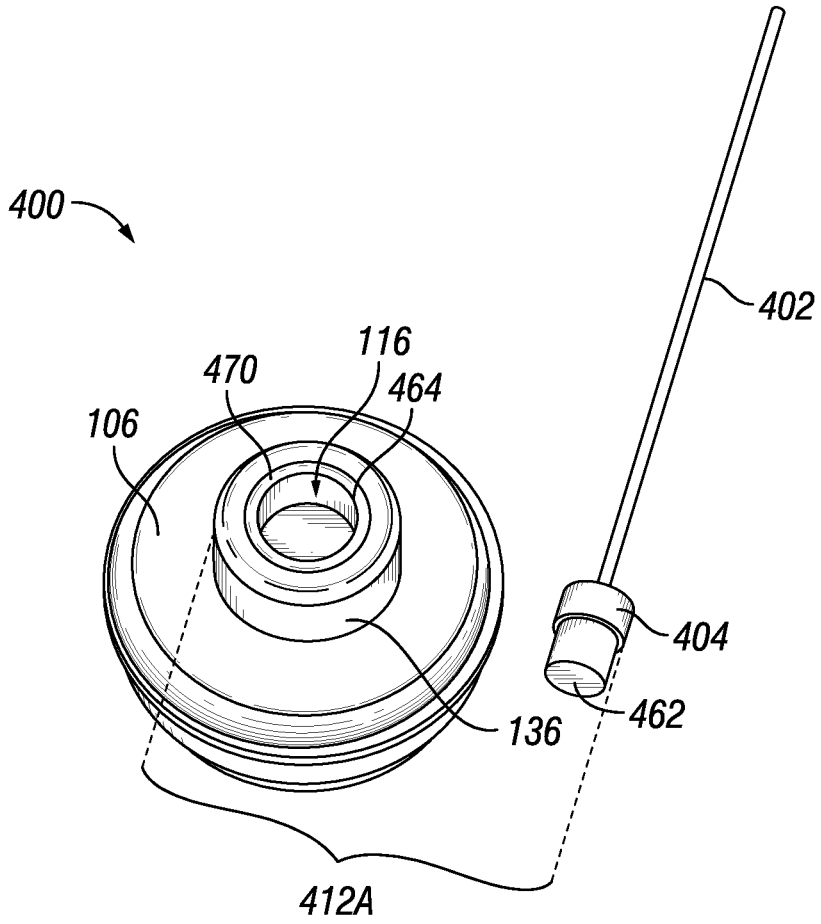
FIG. 4, is a two dimensional drawing of a portable pipe bowl cleaner, in accordance with some embodiments, showing a poker and a base of a disassembled from the pipe bowl cleaner, the poker and base being configured to be magnetically coupled with each other.

Referencing FIG. 4, in some embodiments, a portable pipe bowl cleaner 400 includes a poker coupling mechanism 412A that includes a bottom portion 404 of a poker 402 coupled with a magnet 462. A liner 470 that lines a cavity 116 of the base 106 may include ferromagnetic material 464, which may comprise all or part of a liner 470 or bushing. When the bottom portion 404 of the poker is placed within the liner 470 the magnetic attraction between the magnet 462 and the ferromagnetic material 464 removably couples the base 106 and the bottom portion 404 of the poker 402. In one embodiment, the magnet 462 is separate from, but connected with, the bottom portion 404 of the poker 402. In another embodiment, the bottom portion 404 of the poker 402 is a magnet and the magnet is not separate from the bottom portion 404 of the poker 402.

In the embodiment shown in FIG. 4, a cavity 416 accepts a liner 470 or bushing and the ferromagnetic material forms at least part of the liner 470. In other embodiments, there is no liner or bushing separate from the cavity and the ferromagnetic material forms all or a part of the base 106 defining the cavity 416.

Referencing FIGS. 1, 1A and 4, various combinations of magnets and ferromagnetic material are possible. Magnets may have a first or a second polarity. As used in this document, a magnet's polarity may be north or south. If a first polarity is north, then a second polarity is south, and vice versa. As is well-known, magnets of the same polarity repel each other and magnets of opposite polarity attract each other.

In some embodiments, a poker coupling mechanism 412A comprises a first magnet 462 of a first polarity (e.g., a north polarity) coupled with the bottom portion 404 of the poker 402. A second magnet of a second polarity (e.g., a south polarity) or a ferromagnetic material 464 comprises at least part of a liner 470 or busing that lines the cavity 116 of the first side 136 of the base 102. In an alternative embodiment, there is no separate liner 470, and a second magnet of a second polarity or a ferromagnetic material 464 comprises at least the portion of the base 106 defining the cavity 116.

In some other embodiments, a poker coupling mechanism 412A comprises a magnet of a first polarity that forms at least part of a liner 470 or bushing that lines the cavity 116 and either a magnet of a second polarity or ferromagnetic material 464 is coupled with the bottom portion 404 of the poker.

In alternative embodiments, there is no separate liner 470, and a magnet of a first polarity comprises at least the portion of the base 106 defining the cavity 116 and either a magnet of a second polarity or ferromagnetic material is coupled with the bottom portion 404 of the poker.

Regardless of the various positions of the magnets or ferromagnetic material, the bottom portion 404 of the poker is magnetically coupled with the cavity 416 defined by the first side 326 of the base 106.

Referencing FIGS. 1 and 1A, a portable pipe bowl cleaner 100 may include a suction cup coupling mechanism 112B to directly or indirectly couple the center portion 142 of the exterior surface 152 of the suction cup 108 with the second side 138 of the base 106. In some embodiments, fasteners (e.g., bolts, screws) and threads are used to couple the suction cup 108 with the base 106.

In some embodiments, the suction cup coupling mechanism 112B includes a liner 272 or bushing that lines a cavity 117 that is defined by second side 138 of the base 106. The liner 272 or bushing has internal threads 274. Further, an annular rim 166 is defined by the suction cup 108 and the annular rim 166 defines a hole 120. The hole 120 extends from the center portion 142 of the exterior surface 152 of the suction cup 108 to the internal cup surface 144 of the suction cup 108. In some embodiments, the suction cup coupling mechanism 112B further includes a fastener 110 with external threads 138, such as a bolt, that is capable of being inserted through the hole 120 to threadingly engage the internal threads 274 of the liner 272. Thus, suction cup coupling mechanism 112B indirectly couples—via the externally threaded fastener 110 and the internally threaded liner 272—the center portion of the center portion 142 of the exterior surface 152 of the suction cup 108 with the second side 138 of the base 106.

While a threaded fastener is shown in the embodiments of FIGS. 1 and 1A, in some embodiments, other fasteners are used, such as rivets and pegs. In some other embodiments, the suction cup and base may be magnetically coupled with one another. Further, although FIG. 1 shows a suction cup coupling mechanism 112B that relies on a solid fastener, in other embodiments, a suction coupling mechanism could include a liquid fastener, such as glue to fasten the second side 138 of the base 106 to the center portion 142 of the exterior surface 152 of the suction cup 108. Other equivalent ways of coupling a suction cup 108 and a base 106 are apparent to those skilled in the art.

In the embodiments shown with reference to FIGS. 1 and 1A, a suction cup coupling mechanism 112B may directly connect the center portion of the exterior surface of the suction cup with the second side of the base. But the connection may be direct or indirect.

In some alternative embodiments, there is no liner. In some embodiments, the suction cup coupling mechanism includes internal threads that are defined by the cavity 117 defined by the second side 138. An annular rim 166 is defined by the suction cup 108 and the annular rim 166 defines a hole 120. The hole 120 extends from the center portion 142 of the exterior surface 152 of the suction cup 108 to the internal cup surface 144 of the suction cup 108. The suction cup coupling mechanism 112B further includes a fastener 110 with external threads 138, such as a bolt, that is capable of being inserted through the hole 120 and to threadingly engage with the internal threads of the cavity 117 defined by the second side 138 of the base 106. Thus, in these embodiments, suction cup coupling mechanism 112B directly couples—via the externally threaded fastener 110 and the internally threaded cavity 117—the center portion of the center portion 142 of the exterior surface 152 of the suction cup 108 with the second side of the base 106.

Figure 5:
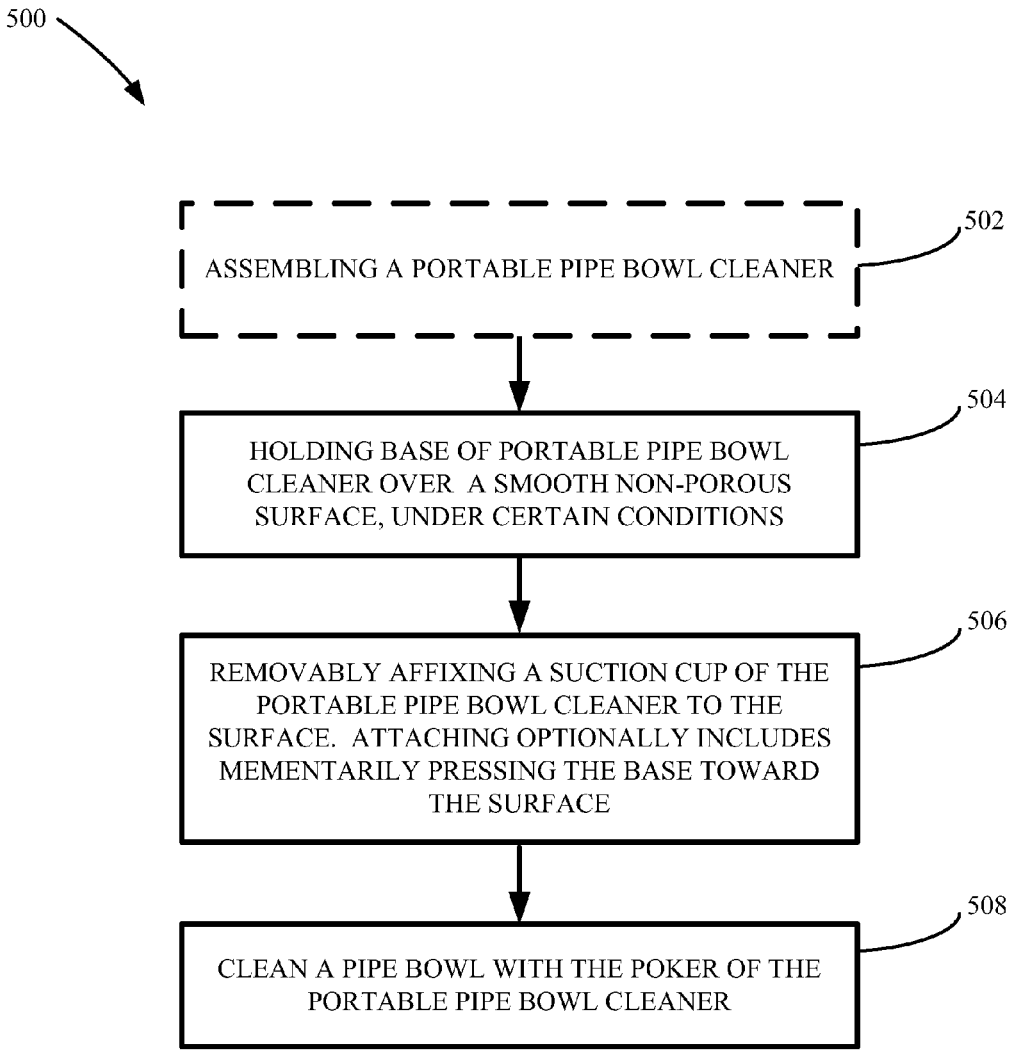
FIG. 5 is a flow-chart illustrating a method of using a portable pipe bowl cleaner, in accordance with some embodiments.

Moving forward with reference to FIG. 5, a method 500 of using a portable pipe bowl cleaner may optionally include assembling 502 a portable pipe bowl cleaner. Some users may prefer to always keep their portable pipe bowl cleaner fully assembled. Other users may prefer to carry their portable pipe bowl cleaner around in a less-bulky, disassembled state. For example, a user may desire to carry the portable pipe bowl cleaner in a coat pocket or in a small case.

Some users may only disassemble the poker from the base. Thus, assembling 502 the portable pipe bowl cleaner may include coupling the poker with the first side of the base (e.g., as shown in FIG. 1). In some embodiments (See, e.g., FIG. 4), the poker is magnetically coupled with the first side of the base.

In some embodiments, assembling 502 also includes coupling the suction cup with the base. As discussed above relative to FIG. 1, various suction cup coupling mechanism may be used to achieve this coupling of the suction cup to the base.

Further referencing FIG. 5, a method 500 of using a portable pipe bowl cleaner includes holding 504 the base of the cleaner over a smooth, non-porous surface, under certain conditions. In some embodiments, these conditions include a poker (e.g., 108 FIG. 1) being coupled with the first side of the base (e.g., 136, 106 of FIG. 1). The base is held 504 to position the base between the surface and the poker. These conditions also include a suction cup being coupled with the second side of the base (e.g., 138, 106 of FIG. 1). The base is held 504 to position the suction cup between the surface and the base. That is, the suction cup is pointed toward the surface.

Further referencing FIG. 5, a method 500 of using a portable pipe bowl cleaner includes removably affixing 506 the suction cup to the surface. Removably affixing the base optionally includes momentarily pressing the base toward the surface and thereby momentarily pressing the suction cup against the surface. After the pressing is performed, the suction cup is removably attached to the surface. That is, pressing the suction cup against the surface forces air out of the area bounded by the surface and the interior cup surface of the suction cup—thus creating a partial vacuum. Once this partial vacuum is created by momentarily pressing the base and thus the suction cup against the surface, the base may be released because the partial vacuum has been created. Exterior air pressure then keeps the suction cup removably affixed to the surface.

As described above with reference to FIG. 1, the surface may comprise a variety of different smooth, non-porous surfaces. In one embodiment, the removably affixing 506 the suction cup to a surface includes removably affixing the suction cup to an interior bottom surface of an ashtray.

Further referencing FIGS. 4 and 5, a method 500 of using a portable pipe bowl cleaner includes cleaning 508 a pipe bowl with the top portion (e.g., 134, FIG. 1) of the poker of the portable pipe bowl cleaner. In some embodiments, because the portable pipe bowl cleaner is removably attached to the surface, the cleaning 508 may be performed while handling the pipe bowl and poker with one hand, as shown in FIG. 4.

The foregoing embodiments and advantages are merely exemplary and are not to be construed as limiting the present invention. Those skilled in the art can appreciate from the foregoing description that the techniques and structures of the embodiments of the invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, the specification, and the following claims.

I claim:

1. A portable pipe bowl cleaner comprising:

a generally linearly extending poker of the pipe bowl cleaner, the poker having a bottom portion and a top portion, the top portion at least being shaped to be poked through a hole of a pipe bowl to remove ash from the pipe bowl;

a base, of the pipe bowl cleaner, having first and second sides, the first side of the base being capable of being coupled with the bottom portion of the poker; and at least one suction cup having an exterior surface and an internal cup surface, a center portion of the exterior surface being capable of being coupled with the second side of the base and the internal cup surface being capable of being removably affixed to a smooth, non-porous surface;

wherein the top and bottom portions of the poker each defines, respectively a first and a second diameter, the second diameter being at least twice as great as the first diameter;

wherein the top portion of the poker has the first diameter throughout its entire length.

2. The portable pipe bowl cleaner of claim 1, wherein the suction cup comprises a single suction cup.

3. The portable pipe bowl cleaner of claim 1, wherein the suction cup defines a diameter between one and two inches.

4. The portable pipe bowl cleaner of claim 1, wherein the first diameter is 1/16 inch and the second diameter is ¼ inch.

5. The portable pipe bowl cleaner of claim 1, wherein the bottom portion of the poker is capable of being detachably coupled with first side of the base.

6. The portable pipe bowl cleaner of claim 1, wherein the bottom portion of the poker has a length of ¼ inch and the entire poker has a length of 3½ inches.

7. The portable pipe bowl cleaner of claim 1, wherein:

the first side of the base comprises a first base height and a first base diameter;

the second side of the base comprises a second base height and a second base diameter, the second base height being greater than the first base height and the second base diameter being greater than the first base diameter.

8. The portable pipe bowl cleaner of claim 1, further comprising a suction cup coupling mechanism to directly or indirectly couple the center portion of the exterior surface of the suction cup with the second side of the base.

9. The portable pipe bowl cleaner of claim 8, wherein the suction cup coupling mechanism comprises:

a cavity defined by the second side of the base;

a internally threaded liner lining the cavity;

an annular rim defined by the suction cup, the annular rim defining a hole extending from the center portion of the exterior surface of the suction cup and through the internal cup surface of the suction cup; and an externally-threaded fastener capable of being inserted through the hole and threadingly engaged with the liner.

10. The portable pipe bowl cleaner of claim 1, further comprising a poker coupling mechanism to directly or indirectly couple the bottom portion of the poker with the first side of the base, the coupling mechanism comprising a cavity defined by the first side of the base to directly or indirectly receive at least a portion of the bottom portion of the poker.

11. The portable pipe bowl cleaner of claim 10, wherein the poker coupling mechanism further comprises:

external threads defined by the bottom portion of the poker;

an internally threaded liner lining the cavity; and wherein the external threads are capable of threadingly engaging the liner to couple the bottom portion of the poker with the first side of the base.

12. The portable pipe bowl cleaner of claim 10, wherein the poker coupling mechanism comprises:

a first magnet of a first polarity coupled with the bottom portion of the poker;

a liner lining the cavity; and wherein the liner comprises one of a ferromagnetic material and a second magnet of a second polarity.

13. The portable pipe bowl cleaner of claim 12, wherein the first magnet is separate from but connected with the bottom portion of the poker.

14. The portable pipe bowl cleaner of claim 10, wherein the poker coupling mechanism comprises:

a liner lining the cavity;

a magnet of a first polarity comprising at least a portion of the liner; and wherein at least part of the bottom portion of the poker comprises one of a ferromagnetic material and a magnet of a second polarity.

15. The portable pipe bowl cleaner of claim 1 wherein the top portion of the poker is made of metal.

* * * * *